US007361325B2

(12) United States Patent
Marakov

(10) Patent No.: US 7,361,325 B2
(45) Date of Patent: Apr. 22, 2008

(54) METHODS FOR MAKING XF•$NH_2O_2$ COMPOUNDS

(75) Inventor: Vladimir Marakov, Prague (CZ)

(73) Assignee: GeoStim Group LLC, Lone Tree, CO (US)

( * ) Notice: Subject to any disclaimer, the term of this patent is extended or adjusted under 35 U.S.C. 154(b) by 570 days.

(21) Appl. No.: 11/025,444

(22) Filed: Dec. 29, 2004

(65) Prior Publication Data

US 2006/0027498 A1 Feb. 9, 2006

Related U.S. Application Data

(60) Provisional application No. 60/599,616, filed on Aug. 6, 2004.

(51) Int. Cl.
*C02B 15/00* (2006.01)

(52) U.S. Cl. ..... 423/490; 34/443; 241/17; 241/18; 432/14; 432/58; 423/499.1

(58) Field of Classification Search ..... 423/272, 423/470, 471, 490, 499.1, 582; 210/634, 210/770, 774; 34/282, 443; 432/14, 58; 507/141, 145, 276, 277; 241/15, 17, 18, 241/19, 23, 24

See application file for complete search history.

(56) References Cited

U.S. PATENT DOCUMENTS 3,415,640 A * 12/1968 Lambert ..... 75/344
5,254,168 A 10/1993 Littman et al.
6,189,234 B1 2/2001 Luker
6,296,790 B1 10/2001 Langseth et al.
6,413,749 B1 7/2002 Becker et al.
6,458,333 B1 * 10/2002 Bulan ..... 423/179
6,767,882 B1 7/2004 Jagannath et al.

FOREIGN PATENT DOCUMENTS

RU 1550832 A1 5/1993

(Continued)

OTHER PUBLICATIONS

Excerpts from a search report letter dated Apr. 15, 2004 from Christopher E. Kondracki of Specialized Patent Services, Arlington, Virginia.

(Continued)

*Primary Examiner*—Joseph Drodge
(74) *Attorney, Agent, or Firm*—Dorr, Carson & Birney, P.C.

(57) ABSTRACT

A substantially dried XF•$nH_2O_2$ product is produced by method(s) wherein a feed solution comprised of (i) a XF composition wherein X is K, $Na^+$ or $NH_4^+$ and n is an integer from 1 to 3, (ii) hydrogen peroxide ($H_2O_2$), (iii) a fluid carrier component and (iv) a potassium bifluoride ($KHF_2$) catalyst, is atomized as it enters a desiccation/evaporation chamber. The atomized feed solution coats fluidized particles passing through the desiccation/evaporation chamber. The coated fluidized particles are dried by a pre-heated gas stream and thereby creating fluid-bed particles that are coated with a layer of the XF•$nH_2O_2$ compound. The resulting XF•$nH_2O_2$ coated fluid-bed particles are then subjected to disintegration forces that serve to break substantial portions of the layer of dried XF•$nH_2O_2$ material from the outer surfaces of he individual fluid-bed particles. These dried XF•$nH_2O_2$ are then recovered as the product of these production methods.

20 Claims, 1 Drawing Sheet

FOREIGN PATENT DOCUMENTS

| | | | |
|---|---|---|---|
| RU | 1467932 | A1 | 10/1993 |
| RU | 2 020 964 | C1 | 10/1994 |
| RU | 2 032 342 | C1 | 4/1995 |
| RU | 2 042 330 | C1 | 8/1995 |
| RU | 2 043 775 | C1 | 9/1995 |
| RU | 2 070 964 | C1 | 12/1996 |
| SU | 854088 | A1 | 4/1990 |

OTHER PUBLICATIONS

Excerpts from a search report letter dated Apr. 24, 1994 from Christopher E. Kondracki of Specialized Patent Services, Arlington, Virginia.

Russian specifications and operating manual for a machine used to make materials comparable to those described in present patent application. An English translation of selected portions of said specifications and operating manual are also provided, Sep. 17, 2007.

* cited by examiner

METHODS FOR MAKING $XF \cdot NH_2O_2$ COMPOUNDS

RELATED APPLICATION

This patent application claims priority to U.S. Provisional Patent Application Ser. No. 60/599,616 filed Aug. 6, 2004 entitled "Methods for Making $XF \cdot nH_2O_2$ Compounds."

BACKGROUND OF THE INVENTION

1. Field of the Invention

This invention is generally concerned with converting solute/solvent compositions into solute-based products through use of desiccation and/or evaporation chambers. More specifically, this invention is concerned with converting solute/solvent compositions to dried solute-based products that are created by injecting atomized portions of such solute/solvent compositions into desiccation/evaporation chambers through which a heated gas stream (e.g., a heated air stream) passes. In effect, the heated gas stream entrains the atomized solute/solvent droplets, heats them and drives off their liquid components to produce a substantially dry, solid form of the solute(s) of the original solute/solvent composition.

These desiccation/evaporation operations have also been carried out in desiccation/evaporation chambers that further comprise a fluid-bed. In such systems, the atomized solute/solvent droplets are sprayed onto the individual, gas stream suspended, particles that make up the fluid-bed. In effect, the sprayed solute/solvent composition coats the gas stream suspended, fluid-bed particles. This coating solidifies on the individual fluid-bed particles as the solvent component of the solute/solvent composition is driven from the surfaces of the individual fluid-bed particles by the heated gas stream. Again, such heated gas streams will normally be heated air.

By way of a more specific example of this art, U.S. Pat. No. 6,296,790 teaches producing magnesium chloride granules by preparing a $MgCl_2$ solution that is, at high temperatures, atomized into a fluid-bed of dried "seeding" particles. In effect, the atomized $MgCl_2$ feed solution coats the seeds with a layer of $MgCl_2$ solution. Meanwhile, a pre-heated air stream is forced upwardly through the fluid-bed to drive off the water component of the $MgCl_2$ feed solution and thereby create dried $MgCl_2$ particles which are the "end product" of this process.

U.S. Pat. No. 6,413,749 teaches production of granules that are ultimately comprised of an admixture of protein and starch that are layered over inert particles (e.g., inert particles comprising inorganic salts, sugars, small organic molecules, clays, etc.). This "layering" of the inert particles with the protein/starch admixture can be accomplished by, among various methods, fluid-bed coating the inert particles with solutions of the protein/starch admixture solution. The end product (i.e., protein and starch coated inert particles) is created when a liquid carrier component of the liquid admixture of protein and starch is driven off through use of a heated air stream.

U.S. Pat. No. 6,767,882 teaches a process for preparing detergent particles having a coating layer of water-soluble inorganic material. The detergent particle comprises a particle core of a detergent active material. This particle core is then at least partially covered by a particle coating layer of a water soluble inorganic material. Particularly preferred inorganic materials are non-hydrate inorganic coating materials such as double salt combinations of alkali metal carbonates, and sulfates. The process includes the steps of passing the core particles through a low speed fluid-bed mixer and thereby coating said core particles with a coating solution or slurry of the water soluble inorganic material.

U.S. Pat. No. 6,189,234 discloses a continuous flow, fluid-bed dryer having a dryer housing which further comprises a drying chamber and a plenum chamber located beneath the drying chamber. Moist product to be dried is introduced into the drying chamber at a product inlet and then proceeds through the drying chamber to a discharge housing. A porous screen partially separates the drying chamber and the plenum chamber. Heated air is introduced into the plenum chamber which then passes through the screen to the drying chamber to dry the product material in the drying chamber. A shaft extends centrally through the drying chamber and is mounted for slow rotation therein. A plurality of paddles are connected to that shaft. The paddles move about a path of rotation such that the paddle ends sequentially sweep over the surface of the screen. In doing so, the paddles momentarily move product away from the screen and thereby permitting a rush of heated air to enter into the drying chamber in order to locally fluidize the particle bed and further drying the product material.

U.S. Pat. No. 5,254,168 teaches a fluid-bed particle coater having a dual-jet and spray arrangement. It includes an upstanding column which has an upper cylindrical section, a tapered intermediate section and a lower cylindrical section. A cylindrical chamber depends from the lower cylindrical section which is connected to tubular sections adapted to introduce multiple air streams via separately controlled inlet openings. The dual-jet and spray construction includes an upwardly-facing spray nozzle positioned in coaxial relationship to the tubular sections. A fountain tube is disposed above a draft tube. The fountain and draft tube concentrically intersect about an intermediate section of the column in an opened telescopic arrangement. The dual-jet and spray particle coater thereby provides multiple coating and drying zones.

2. Discussion of the Background

Peroxysolvate of potassium fluoride compounds i.e., $KF.nH_2O_2$ compounds e.g., potassium fluoride hydroperoxide ($KF.H_2O_2$), potassium fluoride dihydroxide ($KF.2H_2O_2$) and potassium fluoride trihydroperoxide ($KF.3H_2O_2$) have been produced through the use of various heat/cold driven production processes that produce a solute product from a solute/solvent composition. For example, the water components of aqueous solutions of certain solute starting materials (e.g., KF, $KHF_2$, $H_2O_2$) have been frozen through use of liquid nitrogen (especially under vacuum conditions) in order to create $KF.nH_2O_2$ end product compounds. In effect, the solute components of these aqueous solutions (e.g., KF, $KHF_2$, $H_2O_2$) are concentrated and eventually reacted to form the desired $KF.nH_2O_2$ compounds as more and more ice (which is comprised of virtually pure water) is formed from the solvent (water) component of the solute (KF, $KHF_2$, $H_2O_2$)/solvent ($H_2O$) solutions undergoing the liquid nitrogen driven, water freezing operation. Owing to their use of liquid nitrogen as a means of producing freezing conditions, these processes are complex, cumbersome and expensive, especially in large scale operations.

Russian Patent RU 2043775 entitled "Device for Preparation of a Decontaminant and Disinfectant Potassium Fluoride Peroxyhydrate" teaches a method for manufacturing $KF.nH_2O_2$ compounds wherein a working solution comprised of water, potassium fluoride dehydrate ($KF.2H_2O$) and hydrogen peroxide ($H_2O_2$) is created in a mixing tank where these compounds are reacted to create a liquid $KF.nH_2O_2$ composition. After filtering, this composition is fed into a pressure tank, and then into an evaporator unit where the composition's water component is evaporated under vacuum conditions. The resulting dried $KF.nH_2O_2$ product is then transferred to another container that is equipped with an airlock device in order to obtain the dried product without losing the system's temperature and vacuum conditions. This production system is complex and therefore expensive to build and operate—especially owing to its use of vacuum conditions to carry out its evaporation process).

Russian Patent SU 1467932 A1 also teaches creation of $KF.nH_2O_2$ products through use of vacuum conditions in its reaction chamber.

Russian journal: Zh. Neorg. Khim: vol 32, pages 26 12-15 (1987) contains an article entitled "Potassium Fluoride Peroxyhydrates $KF.H_2O_2$, $KF.2H_2O$ and $KF.3H_2O$." It also teaches use of vacuum conditions in evaporation chambers to produce $KF.nH_2O_2$ products.

Other Russian workers have prepared peroxysolvate of potassium fluoride compounds using potassium fluoride dihydrate ($KF.2H_2O$) as catalysts in production systems wherein aqueous $KHF_2$, $H_2O_2$, and $KF.2H_2O$ feed solutions were fed into heated air streams in order to drive off the water component of these feed solutions. These production systems also employed vacuum conditions in their evaporation chamber. None of these systems, however, employed fluid-bed systems as a part of their modus operandi. In any case, these prior art production systems produced $KF.H_2O_2$ end product yields of about 22%. These product yield results are to be compared to those of applicant's methods—which produce $KF.H_2O_2$ end product yields of about 50%.

SUMMARY OF THE INVENTION

The present invention provides method(s) for making dried compounds having the general formula $XF{\bullet}nH_2O_2$ wherein X is $K^+$, $Na^+$ or $NH_4^+$ and n is an integer from 1 to 3. These $XF{\bullet}nH_2O_2$ compounds are especially useful in making up liquid compositions that are useful in: (1) oil field operations (fracturing, flooding, etc.), (2) paper bleaching, (3) disinfectants (e.g., biological agent control materials) etc. Some of the more important compounds falling under the above noted formula are peroxysolvate of potassium fluoride compounds i.e., $KF.nH_2O_2$ compounds (hereinafter sometimes referred to as "PPF compounds" or "PPFs"), e.g., potassium fluoride hydroperoxide ($KF.H_2O_2$), potassium fluoride dihydroperoxide ($KF.2H_2O_2$) and potassium fluoride trihydroperozide ($KF.3H_2O_2$).

Applicant's method(s) of making such compounds generally comprise: (1) preparing a feed solution comprised of: (i) a XF composition wherein X is K, $Na^+$, $NH_4^+$ (or compositions wherein a KF composition is replaced in whole, or in part, by a $KHF_2$ composition and/or a $KF.2H_2O$ composition), (ii) hydrogen peroxide ($H_2O_2$), (iii) a liquid carrier component (e.g., water) and (iv) an effective amount of a $XF{\bullet}nH_2O_2$-creating catalyst and/or solute ingredient compound e.g., potassium bifluoride ($KHF_2$) which is also sometimes called "potassium acid fluoride" or "potassium hydrofluoride"; (2) atomizing a portion of the feed solution as it enters a desiccation/evaporation chamber; (3) passing a pre-heated gas stream through the desiccation/evaporation chamber such that said pre-heated gas stream: (i) entrains a portion of an atomized portion of the feed solution, (ii) drives off the fluid carrier component of the feed solution, (iii) creates a dried form of a $XF{\bullet}nH_2O_2$ end product; and (4) capturing said dried form of the $XF{\bullet}nH_2O_2$ end product.

A particularly effective embodiment of applicant's method(s) also employs a fluid-bed in the desiccation/evaporation chamber. The fluid-bed is comprised of one or more species of individual particles that are "fluidized" (i.e., supported/carried) by a pre-heated gas stream that passes through the desiccation/evaporation chamber. The individual fluid-bed forming particles can be chemically inert, chemically active and/or catalytic in nature. For example, various fluoroplastic beads can be used to make chemically inert fluid-bed particles. In any case, under the fluidized-bed conditions, the above-noted atomized portions of the feed solution tend to coat the outside surfaces of the individual particles that make up the fluid-bed. Consequently, the pre-heated gas stream: (i) entrains those feed solution-coated, individual fluid-bed creating particles that have been sprayed by the atomizer, (ii) drives off the liquid carrier component of the feed solution that coats said particles and thereby creating individual fluid-bed particles that are covered, or at least partially coated with, a layer of dried $XF{\bullet}nH_2O_2$ material, and (iii) delivers said coated individual fluid-bed particles to a separation zone where said coated particles are subjected to disintegration forces sufficient to break substantial portions of a layer of dried $XF{\bullet}nH_2O_2$ from the surfaces of the individual fluid-bed particles, but insufficient to substantially break the individual, fluid-bed particles themselves—if said fluid-bed particles are to be reused, rather than becoming a component of the final product. In either case, the resulting dried $XF{\bullet}nH_2O_2$ particles are then separated from the air stream that carries them. They are then collected as the end product of these methods of making dried $XF{\bullet}nH_2O_2$ materials.

It might also be noted here that, for the purposes of this patent disclosure, if the desiccation/evaporation chamber is not placed under vacuum conditions, it can "roughly" be thought of and described as a desiccation chamber that "desiccates" the subject solute/solvent composition. Placing the chamber under vacuum conditions could generally serve to more quickly "evaporate" the solvent component of the solute/solvent composition. This possible evaporation aspect of applicant's invention, however, considerably increases the costs of building and operating the apparatus used to carry out the method(s) of this patent disclosure. Moreover, the process yields are not greatly improved through use of vacuum conditions. Hence, the use of vacuum conditions in the desiccation/evaporation chamber is generally less preferred relative to the use of desiccating, non-vacuum, conditions. Nonetheless, the chamber will be referred to as "desiccation/evaporation" chamber to at least acknowledge the possibility that vacuum conditions may, sometimes, be employed in such a chamber.

Be the desiccation/evaporation characterizations as they may, applicant has also found that the amount of dried $XF{\bullet}nH_2O_2$ product that can be layered on, and then removed from, the fluid-bed particles, can, to a large degree, be controlled (aside from the potentially controlling influences of heat, pressure, residence time, solute concentration on applicant's processes) by controlling the pH of the feed solution. For example, applicant has found that optimal pH levels for such feed solutions will generally range from about 6.5 to about 7.5—with ranges from about 7.0 to about 7.5 being preferred. Applicant also has found that potassium bifluoride ($KHF_2$) is a particularly effective pH control agent in the formulation of feed solutions of this patent disclosure. Moreover, use of a potassium bifluoride ($KHF_2$) ingredient also encourages production of certain gases (e.g., $O_2$) in the desiccation/evaporation chamber. The presence of such gases in desiccation/evaporation chamber also aids in desiccating the liquid component of the feed solution.

Applicant has also found that the hereindescribed methods for making the dried $XF{\bullet}nH_2O_2$ compounds of this patent disclosure can be enhanced by: (1) vibrating the desiccation/evaporation chamber, (2) sometimes placing the desiccation/evaporation chamber under vacuum conditions, (3) preheating the feed solution, (4) lowering the moisture content of the heated gas stream (e.g., air) used to create the fluid-bed in the desiccation chamber, (5) employing an incoming gas stream perturbing device (e.g., an "air confusor device"), (6) heating the fluid-bed particles while they are in the desiccation/evaporation chamber, (7) providing coated particle impact surfaces in the desiccation/evaporation chamber, (8) employing fluid-bed creating particles that also serve as catalysts in creating the $XF{\bullet}nH_2O_2$ product from the solute components (e.g., KF, $KHF_2$, $H_2O_2$) of the feed solution and (9) employing fluid-bed creating particles that become a core component of an outside layer/core particle $XF{\bullet}nH_2O_2$ final product.

DETAILED DESCRIPTION OF THE INVENTION

Figure 1:
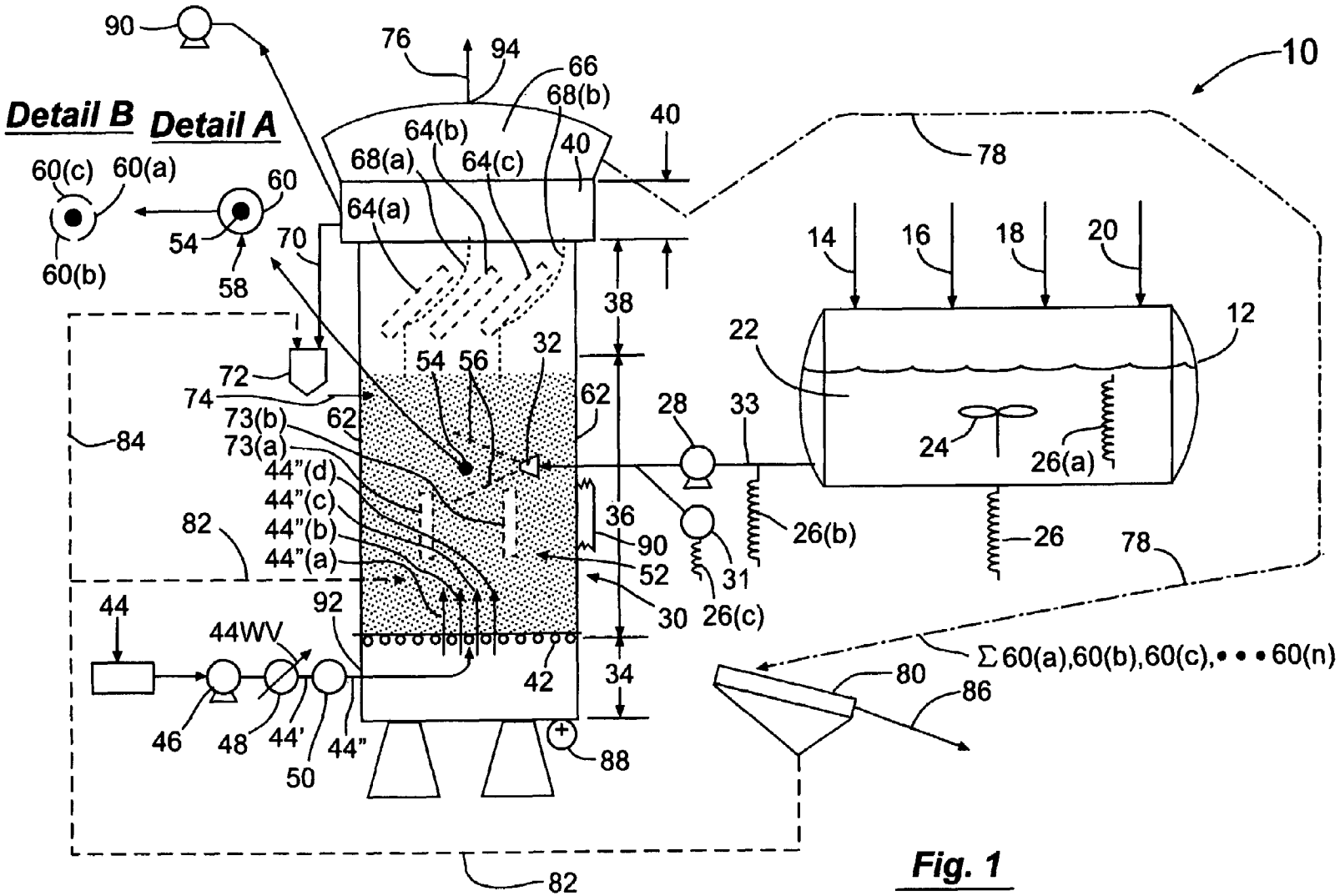
FIG. 1 is a cross-sectional view of a representative desiccation/evaporation chamber device for carrying out some of the hereindescribed method(s) for making dried compounds having the general formula $XF{\bullet}nH_2O_2$.

FIG. 1 depicts an apparatus 10 for carrying out several different embodiments of applicant's methods of making dried $XF{\bullet}nH_2O_2$ products—and especially dried PPF compounds. The present invention can be thought of as beginning with a mixing tank 12 shown provided with a series of inlet streams 14, 16, 18 and 20. These inlet streams supply the ingredients (including catalysts) that make up an overall composition 22 (that becomes a "feed solution" for the manufacture of the hereindescribed dried $XF{\bullet}nH_2O_2$ products) that is contained in the mixing tank 12 prior to deployment of said composition into the production process. For example, stream 14 can deliver a liquid carrier component (such as water, dilute alcohol, weak acids, glycerol and so on) of the feed solution 22 that will be formulated in tank 12. This liquid carrier component can comprise from about 53 weight percent to about 97 weight percent of the overall composition 22.

Similarly, stream 16 can deliver a first solute ingredient of the feed solution 22. For example, this first solute ingredient can be potassium fluoride (KF) introduced as a powder or as a liquid. This potassium fluoride (KF) may be mixed with, or replaced, in whole or in part, by potassium bifluoride ($KHF_2$) and/or potassium fluoride dihydrate ($KF.2H_2O$) powder, or liquid, composition. This first solute ingredient will be employed in concentrations such that it preferably constitutes from about 1 to about 25 weight percent of the overall composition 22. As suggested by the general formula for the end products of the methods of this patent disclosure (i.e., $XF{\bullet}nH_2O_2$ where X can be $K^+$, $Na^+$ or $NH_4^+$), the first solute ingredient also could be a sodium fluoride composition or an ammonium fluoride composition.

Stream 18 can be used to introduce a second solute, namely a hydrogen peroxide ($H_2O_2$) component of the feed solution 22. This hydrogen peroxide component will, likewise, preferably be employed in concentrations such that it too will constitute from about 1 to about 25 weight percent of the overall composition 22. Preferably, the first solute (e.g., KF) and the second solute ($H_2O_2$) will be used in roughly equal concentrations (by weight percentage) in the overall composition 22.

Stream 20 can be used to introduce a third solute component, i.e., a catalyst/solute ingredient suitable for taking part in (and/or catalyzing) the desired chemical reactions of this patent disclosure (e.g., those of KF and $H_2O_2$) to produce the desired $XF{\bullet}nH_2O_2$ end products. Again, such a catalyst/solute ingredient can influence both the methods and the physical end products of this patent disclosure. For example, applicant has found that a potassium bifluoride ($KHF_2$) catalyst/solute ingredient—especially in concentrations ranging from about 0.1 to about 15.0 weight percent of the other solutes (e.g., KF and $H_2O_2$), that make up the feed solution 22—can serve as a particularly effective catalyst/solute ingredient in producing the dried $XF{\bullet}nH_2O_2$ products of this patent disclosure. Generally speaking, the higher end of this catalyst/ingredient concentration range (e.g., from about 8.0 to about 15.0 weight percent of the other solute ingredients) will be employed when the first and second solutes (e.g., KF and $H_2O_2$) contain relatively high levels of "impurities" (i.e., those solute ingredients that are not KF and/or not $H_2O_2$). Be that as it may, applicant has found that the presence of a potassium bifluoride ($KHF_2$) component in the feed solution composition 22 is particularly useful in producing the desired products and in controlling the pH of said composition (especially between the desired pH levels of from about 6.5 to about 7.5). Moreover, this pH control capability can be used as a basis for controlling the amount of dried $XF{\bullet}nH_2O_2$ that will be layered on the fluid-bed particles used in this process. This all goes to say that even though the production rate of the $XF{\bullet}nH_2O_2$ product will, to some extent, also depend on the temperature and velocity of the heated gas (e.g., air) stream, on the solute concentrations, on the proportions of the feed solution, on the pressure at which the feed solution is fed into the desiccation/evaporation chamber and on the temperature of the desiccation chamber, the production rate and/or production amounts of the dried $XF{\bullet}nH_2O_2$ end products (and especially the amounts layered onto individual fluid-bed particles) can be conveniently controlled through control of the pH of the feed solution 22—especially through use of potassium bifluoride ($KHF_2$) as an ingredient/catalyst/pH control agent which, in turn, can be used to control the rate/amount of the desired end product material that is layered onto the fluid-bed particles. In any case, such a potassium bifluoride ($KHF_2$) catalyst/ingredient component also can be separately introduced into the mixing tank 12 as a powder, or as a liquid, composition. The potassium bifluoride ($KHF_2$) component also could be admixed with one or more of the other ingredients (e.g., with the water, the KF, $KHF_2$ and/or the $H_2O_2$) that make up the overall composition 22 formulated in the mixing tank 12.

FIG. 1 also suggests that the solute/solvent composition 22 contained in tank 12 can be thoroughly mixed and heated. The tank 12 is, for example, shown provided with a mixing device 24. Various heater elements, e.g., 26, 26(*a*), 26(*b*), 26(*c*) are shown associated with the tank 12 and its associated equipment (e.g., with compressor 31, line 33, etc.) as well. Be the locations of such heaters as they may, feed solution 22 is removed from tank 12 and transported, e.g., by a pump 28, to a desiccation/evaporation chamber 30 where one or more spray nozzles 32 atomize the feed solution 22 in a fluidizing zone of said chamber 30. Two phase nozzles 32 using compressed air (e.g., from an air compressor 31 that delivers air, preferably pressured from about 0.5 to about 10 bar, and more preferably from about 2 to about 5 bar) can be conveniently employed. Air streams having approximately the same temperature as the feed solution 22 are preferred.

The atomization nozzle(s) 32 can be aimed from the top, sides or bottom of the fluidizing zone 36. Side injection of the feed solution 22 (as depicted in FIG. 1) is somewhat preferred, but downward spraying from above the fluid-bed height level also can be employed to advantage in certain chamber 30 configurations. In any case, the feed solution 22 will preferably have solute concentrations ranging from about 3 to about 53 weight percent (and more preferably from about 20 to about 40 weight percent) of the feed solution 22. Such feed solutions 22 are preferably injected at temperatures near that of the feed solution's boiling point—which will usually be in the range of about 120 to about 130° C. Feed solutions 22 having higher solute concentrations may require somewhat higher temperatures (up to temperatures of about 170° C.).

Next, it should be noted that the desiccation/evaporation chamber 30 is preferably comprised of several zones which may be created by actual physical sub-chamber components (not shown) of the overall desiccation/evaporation chamber 30 apparatus. Such chamber zones preferably will include a: (1) a gas pre-distribution zone 34, a fluidizing/particle coating zone 36, a particle drying zone 38 and a fluid-bed particle/coating layer particle separation zone 40. These zones are, however, in fluid communication with each other and may, to a considerable extent, overlap with each other in performing their various process functions (e.g., as in the case of the fluidizing/particle coating zone 36 wherein particles may be fluidized, coated and physically collided to free their dried $XF{\bullet}cH_2O$ layers). The fluid-bed particle/coating layer particle separation zone 40 is created by an air/particle outtake device (also generally designated by item 40) shown positioned over the particle drying zone 38 of chamber 30. This air/particle outtake device 40 is in fluid communication with the particle drying zone 38 of chamber 30. It is also in fluid communication with a cyclone positioned above it.

FIG. 1 also depicts a perforated plate or screen 42 that physically separates the pre-distribution zone 34 from the fluidizing/particle coating zone 36 while still permitting fluid communication between these two zones. A gas stream 44 (e.g., of air) is shown being drawn (e.g., by compressor/pump 46) into the pre-distribution zone 34 of the desiccation/evaporation chamber 30. In this pre-distribution zone 34, the incoming gas 44 (e.g., air) starts to be broken into substreams 44"(*a*), 44"(*b*), 44"(*c*), 44"(*d*), etc. by means of holes in the perforated plate 42 in order that the incoming gas 44 is more uniformly distributed into the fluidizing/particle coating zone 36 located immediately above the perforated plate 42. This incoming gas (e.g., air 44) is preferably heated by a heater 48 before said gas enters the pre-distribution zone 34. This all goes to say that a fluid-bed is created in zone 36 by passing a gas, and preferably a pre-heated gas (e.g., pre-heated air), through said zone 36. The pre-heated gas preferably has a temperature high enough to maintain the fluid-bed between about 130° C. and about 150° C. To achieve this, the fluidization inlet gas temperature may range from about 100° C. to about 170° C., but more preferably from about 130° C. to about 150° C.

The heater 48 used to heat the incoming gas (air) 44 can employ electricity or steam depending on local availabilities. Thus, the fluidizing gas 44 can be directly heated by an electrical heater device, or indirectly heated by heat exchangers if gas burners are used. The heater 48 should be capable of raising the temperature of the incoming gas 44 to a level capable of driving off (e.g., desiccating/evaporating) a liquid (e.g., water) component of the feed solution 22 that is being injected into fluidizing/particle coating zone 36 via the spray nozzle 32. In the case of the incoming gas 44 being air, it is also preferred that the air be subjected to temperatures capable of driving off a large portion of the water vapor content 44WV of said air and thereby creating a dried air stream 44'. The resulting dried, heated air stream 44' also may be subjected to perturbation actions (e.g., by a confusor device 50), in order to create a heated, pulsating air stream 44" in the pre-distribution zone 34.

Upon entering the fluidizing/particle coating zone 36, the rising heated, pulsating gas (e.g., air) substreams 44"(*a*), 44"(*b*), 44"(*c*), 44"(*d*), etc. serve to fluidize a body 52 of fluid-bed particles that resides in the fluidizing/particle coating zone 36 of the desiccation/evaporation chamber 30. In such a fluidized condition, any given fluid-bed particle 54 that falls within a spray zone 56 of feed solution 22 that is created by spray nozzle 32 is substantially coated with said feed solution 22. A highly enlarged, representative, coated fluid-bed particle 58 is depicted in "Detail A" which is shown outside of the desiccation/evaporation chamber 30 for purposes of clarifying the "coated" nature of the fluid-bed particle 54. That is to say that such a particle 58 has a core component, i.e., a fluid-bed particle 54, and a coating component 60 that, in effect, surrounds a substantial portion of the outside surface of the core component (i.e., particle 54). This coating component 60 is comprised of the feed solution 22 sprayed onto the particle 54 by the nozzle 32 when said particle 54 passes through the nozzle's spray zone 56.

Initially, the coating component 60 is in a liquid state. It is, however, quickly converted into a substantially dry state by virtue of having the liquid component 14 (e.g., water) of the feed solution 22 driven off the core particle 54 by the temperature and flow conditions (and, in some less preferred cases, vacuum conditions) extant in the desiccation/evaporation zone 36 as such a coated particle 58 is entrained in the pre-heated air stream(s) 44"(*a*), 44"(*b*), 44"(*c*), 44"(*d*), etc. that flow upward through the fluidizing/particle coating zone 36. Again, fluidized bed temperatures ranging from about 130° C. to about 150° C. are preferred. As suggested in Detail A, after the liquid component 14 of the feed solution 22 is driven from the particle's surface, the solute component of the feed solution 22 is left on the particle in the form of a substantially dried layer 60.

After it is sufficiently dried, the resulting $XF{\bullet}nH_2O_2$ layer 60 takes on a brittle quality such that, upon collision with other particles and/or collision with an inside surface 62 of chambers 36 and 38 (optionally, including strategically located particle collision plates 64(*a*), 64(*b*), 64(*c*), etc.), the layer 60 breaks into pieces, e.g., pieces 60(*a*), 60(*b*), 60(*c*), etc. as generally suggested in "Detail B" of FIG. 1. That is to say that the brittle layer 60 is broken by the impact, shear, abrasion, etc. forces the coated particles encounter in a fluid-bed system. Such pieces 60(*a*), 60(*b*), 60(*c*), etc. are substantially comprised of a dried $XF{\bullet}nH_2O_2$ reaction product of the solute components of the original feed solution 22. These pieces 60(*a*), 60(*b*), 60(*c*), etc. are collected (along with those broken from other fluid-bed particles) as the "product" of this method of making the $XF{\bullet}nH_2O_2$ materials of this patent disclosure.

Upon leaving the drying zone 38 of the chamber 30, the air-entrained fluid-bed particles 54 are separated from the product pieces 60(*a*), 60(*b*), etc. by the air/particle outtake device 40 device that, in effect, creates the fluid-bed particle/ coating layer particle separation zone 40. The air/particle outtake device 40 passes the product pieces 60(*a*), 60(*b*), 60(*c*), etc. and sends them to a cyclone 66 located above zone 40. That is to say that this device 40 continuously takes up streams 68(*a*), 68(*b*), etc. of uncoated fluid-bed particles 54. These, now substantially uncoated fluid-bed particles 54, are sent (via line 70) to a particle collection/dispensing device 72 which then injects these now uncoated fluid-bed particles 54 (via line 74) back into the fluidizing/particle coating zone 36. It might also be noted that the temperature of the fluid-bed 52 may be further controlled through use of heaters 73(*a*), 73(*b*) located in the fluidizing/particle coating zone 36.

Meanwhile, the product pieces 60(*a*), 60(*b*), 60(*c*) that are sent to the cyclone 66 where they are separated from an air stream 76 that entrains them. This air stream 76 is then ejected from the cyclone 66 to the atmosphere. The cyclone-collected product pieces 60(*a*), 60(*b*), 60(*c*), etc. are then sent from the cyclone 66 (via line 78) to a final product collection device 80. This final product collection device 80 may also include a particle classification device (not shown) that is capable of separating particle "fines" from appropriately sized end product "flakes." The fines can be sent back to the fluidizing/particle coating zone via line 82 and/or via line 82 and line 84. Be that as it may, an appropriately sized, dried $XF{\bullet}nH_2O_2$ product 86 is removed from the collection device 80 for shipment or local use.

Next, it should be noted that the apparatus 10 depicted in FIG. 1 can be further provided with several additional features which can enhance the methods and physical products of this patent disclosure. For example, the desiccation/evaporation chamber 30 can be provided with a vibration producing device to shake dried $XF{\bullet}nH_2O_2$ product and/or fluid-bed particles free of any inside surfaces 62 of the desiccation/evaporation chamber 30. Cam 88 symbolizes the ability to vibrate (preferably vibrate vertically) the chamber 30 with respect to a frame system depicted by frame component 90. Physical chamber 38 is therefore preferably joined to the fluid-bed particle outtake device 40 by a flexible compensator device (not shown) that allows chamber 38 to be vibrated in a vertical plane while the fluid particle outtake 40 remains attached to a component of the frame system 90. Moreover, some embodiments of this invention will have chambers 30 that create zones 34 and 38 chamber apparatus that are permanently affixed to the frame system 90 while the physical chamber (not shown) that creates zone 36 is removably attached to said frame 90 so that the physical chamber that creates zone 36 can be removed from the overall chamber 30 for cleaning and repairs.

Further control of the methods of this patent disclosure can be accomplished in other ways as well. For example, thermometers can be placed on the desiccation chamber 30 (e.g., to detect the air temperature at an desiccation chamber intake 92 and at an air outtake 94). Such a thermometer system permits monitoring and control of the overall process.

This patent disclosure sets forth a number of specific embodiments of the present invention. Those skilled in these arts will however appreciate that various changes, modifications, methods of construction, and feed solution compositional variations could be practiced under the teachings of this patent without departing from its scope as set forth in the following claims.

What is claimed is:

1. A method of making a substantially dried compound having the general formula $XF{\bullet}nH_2O_2$ wherein X is $K^+$, $Na^+$ or $NH_{4+}$ and n is an integer from 1 to 3, said method comprising:

(1) preparing a feed solution comprised of: (i) a fluid carrier component, (ii) a XF composition wherein X is K, $Na^+$ or $NH_{4+}$, (iii) hydrogen peroxide ($H_2O_2$), and (iv) potassium bifluoride ($KHF_2$);

(2) atomizing a portion of the feed solution as it enters a desiccation/evaporation chamber;

(3) creating a fluid-bed of individual particles in the desiccation/evaporation chamber in order that the atomized portion of the feed solution entering said chamber coats outside surface areas of said individual particles;

(4) passing a pre-heated gas stream through the desiccation/evaporation chamber such that said pre-heated gas stream:

(i) entrains feed solution-coated individual particles of the fluid-bed;

(ii) drives off the fluid carrier component of the feed solution and thereby producing individual fluid-bed particles that are coated with a layer of dried $XF{\bullet}nH_2O_2$; and (iii) delivers said individual fluid-bed particles to a separation zone where such particles are subjected to disintegration forces sufficient to break substantial portions of the layer of dried $XF{\bullet}nH_2O_2$ from outer surfaces of the individual fluid-bed particles, but insufficient to substantially break said individual fluid-bed particles themselves;

(5) separating a resulting, substantially dried $XF{\bullet}nH_2O_2$ product from the individual fluid-bed particles; and (6) collecting the substantially dried $XF{\bullet}nH_2O_2$ product.

2. The method of claim 1 wherein a KF composition is replaced, at least in part, by a $KHF_2$ composition.

3. The method of claim 1 wherein the feed solution is provided with a $KF.2H_2O$ composition in place of some or all of a KF composition that would otherwise be employed as a possible ingredient in said feed solution.

4. The method of claim 1 wherein the desiccation/evaporation chamber is vibrated.

5. The method of claim 1 wherein the desiccation/evaporation chamber is placed under vacuum conditions.

6. The method of claim 1 wherein the feed solution is pre-heated before it is injected into the desiccation/evaporation chamber.

7. The method of claim 1 wherein the heated gas stream is perturbed before it enters the desiccation/evaporation chamber.

8. The method of claim 1 wherein the fluid-bed particles are heated in the desiccation/evaporation chamber.

9. The method of claim 1 wherein coated particle impact surfaces are provided in the desiccation/evaporation chamber.

10. The method of claim 1 wherein the individual fluid-bed particles in the desiccation/evaporation chamber also serve to catalyze production of $XF{\bullet}nH_2O_2$.

11. The method of claim 1 wherein the fluid-bed creating particles are used as a core upon which the dried $XF{\bullet}nH_2O_2$ layer remains to form an outside layer/core end product.

12. A method of making a substantially dried compound having the general formula $KF.nH_2O_2$ wherein n is an integer from 1 to 3, said method comprising:

(1) preparing a feed solution comprised of: (i) a fluid carrier component, (ii) a KF composition, (iii) hydrogen peroxide ($H_2O_2$), and (iv) potassium bifluoride ($KHF_2$);

(2) atomizing a portion of the feed solution as it enters a desiccation/evaporation chamber;

(3) creating a fluid-bed of individual particles in the desiccation/evaporation chamber in order that the atomized portion of the feed solution entering said chamber coats the outside surfaces of said individual particles;

(4) passing a pre-heated gas stream through the desiccation/evaporation chamber such that said pre-heated gas stream:

(i) entrains feed solution-coated individual particles of the fluid-bed;

(ii) drives off the fluid carrier component of the feed solution and thereby producing individual fluid-bed particles that are coated with a layer of dried $KF.nH_2O_2$; and (iii) delivers said individual fluid-bed particles to a separation zone where such particles are subjected to disintegration forces sufficient to break substantial portions of the layer of dried $KF.nH_2O_2$ from outer surfaces of the individual fluid-bed particles, but insufficient to substantially break said individual fluid-bed particles themselves;

(5) separating a resulting, substantially dried $KF.nH_2O_2$ product from the individual fluid-bed particles; and (6) collecting the substantially dried $KF.nH_2O_2$ product.

13. The method of claim 12 wherein a KF composition is, at least in part, replaced by $KHF_2$.

14. The method of claim 12 wherein the feed solution is provided with a $KF.2H_2O$ composition in place of some or all of a KF composition that would otherwise be employed as a possible ingredient in said feed solution.

15. The method of claim 12 wherein the desiccation/evaporation chamber is vibrated.

16. The method of claim 12 wherein the desiccation/evaporation chamber is placed under vacuum conditions.

17. The method of claim 12 wherein the feed solution is pre-heated before it is injected into the desiccation/evaporation chamber.

18. The method of claim 12 wherein the heated gas stream is perturbed before it enters the desiccation/evaporation chamber.

19. The method of claim 12 wherein the fluid-bed particles are heated in the desiccation/evaporation chamber.

20. A method of making a substantially dried compound having the formula $KF.H_2O_2$, said method comprising:

(1) preparing a feed solution comprised of: (i) an aqueous carrier component, (ii) a KF composition that comprises from about 1.0 to about 25.0 weight percent of the feed solution, (iii) hydrogen peroxide ($H_2O_2$) that comprises from about 1.0 to about 25.0 weight percent of the feed solution, and (iv) potassium bifluoride ($KHF_2$);

(2) atomizing a portion of the feed solution as it enters a desiccation/evaporation chamber;

(3) creating a fluid-bed of individual particles in the desiccation/evaporation chamber in order that the atomized portion of the feed solution entering said chamber coats the outside surfaces of said individual particles;

(4) passing a pre-heated gas stream through the desiccation/evaporation chamber such that said pre-heated gas stream:

(i) creates temperatures ranging from about 130° C. to about 150° in the chamber;

(ii) entrains feed solution-coated individual particles of the fluid-bed;

(iii) drives off the fluid carrier component of the feed solution and thereby producing individual fluid-bed particles that are coated with a layer of dried $KF.H_2O_2$; and (iv) delivers said individual fluid-bed particles to a separation zone where such particles are subjected to disintegration forces sufficient to break substantial portions of the layer of dried $KF.H_2O_2$ from outer surfaces of the individual fluid-bed particles, but insufficient to substantially break said individual fluid-bed particles themselves.

* * * * *